US009920561B2

(12) United States Patent
Fan

(10) Patent No.: US 9,920,561 B2
(45) Date of Patent: Mar. 20, 2018

(54) COMBINATION HYDRAULIC AND PNEUMATIC DOOR CLOSER

(71) Applicant: Cmech (Guangzhou) Ltd., Guangdong (CN)

(72) Inventor: Shuiwang Fan, Guangzhou (CN)

(73) Assignee: Cmech (Guangzhou) Ltd., Guangdong (CN)

( * ) Notice: Subject to any disclaimer, the term of this patent is extended or adjusted under 35 U.S.C. 154(b) by 0 days.

(21) Appl. No.: 15/335,002

(22) Filed: Oct. 26, 2016

(65) Prior Publication Data

US 2017/0081892 A1 Mar. 23, 2017

Related U.S. Application Data

(63) Continuation-in-part of application No. 14/795,004, filed on Jul. 9, 2015, now Pat. No. 9,556,659.

(30) Foreign Application Priority Data

Jun. 11, 2015 (CN) ..... 2015 1 0318849

(51) Int. Cl.
*E05F 1/10* (2006.01)
*E05F 3/00* (2006.01)
(Continued)

(52) U.S. Cl.
CPC ..... *E05F 3/02* (2013.01); *E05F 1/105* (2013.01); *E05F 3/10* (2013.01); *E05F 3/104* (2013.01);
(Continued)

(58) Field of Classification Search
CPC ..... Y10T 16/56; Y10T 16/577; Y10T 16/585; Y10T 16/27; Y10T 16/2804; Y10T 16/281; Y10T 16/285; Y10T 16/286; Y10T 16/293; Y10T 16/299; Y10T 16/61; Y10T 16/62; E05F 3/00; E05F 3/02; E05F 3/04; E05F 3/102; E05F 3/104; E05F 3/10;
(Continued)

(56) References Cited

U.S. PATENT DOCUMENTS 1,966,956 A * 7/1934 Dunn ..... E05F 5/027 16/49
2,108,891 A * 2/1938 Johnson ..... E05F 3/16 16/66
(Continued)

FOREIGN PATENT DOCUMENTS

CN 201106346 8/2008
DE 102011087695 A1 * 6/2013 ..... E05F 5/08
JP 2008196256 8/2008

*Primary Examiner* — Chuck Mah
(74) *Attorney, Agent, or Firm* — McKee, Voorhees & Sease, PLC

(57) ABSTRACT

A door closer capable of adjusting door closing speed, includes a pneumatic cylinder on the door frame, a hydraulic cylinder on the door, and a lever. One end of the lever is movably connected to the pneumatic cylinder, and the other end is connected to the hydraulic cylinder. The pneumatic cylinder includes a sliding rail, and a sliding member cooperated with the sliding rail. A hermetic chamber is formed by the sliding member and the sliding rail. An adjusting valve, for adjusting the air exhaust of the hermetic chamber, is provided on a wall of the hermetic chamber.

15 Claims, 9 Drawing Sheets

(51) Int. Cl.

| | |
|---|---|
| ***E05F 3/02*** | (2006.01) |
| ***E05F 3/10*** | (2006.01) |
| ***E05F 5/08*** | (2006.01) |
| *E05F 3/22* | (2006.01) |

(52) U.S. Cl.
CPC ..... *E05F 5/08* (2013.01); *E05F 2003/228* (2013.01); *E05Y 2201/686* (2013.01); *E05Y 2900/132* (2013.01)

(58) Field of Classification Search
CPC ..... E05F 3/227; E05F 5/06; E05F 5/08; E05F 5/10; E05F 2003/228; E05C 17/04; E05C 17/28; E05C 17/30
See application file for complete search history.

(56) References Cited

U.S. PATENT DOCUMENTS 2,958,089 A * 11/1960 Roehm ..... E05C 17/24 16/49
3,630,560 A * 12/1971 Atkins ..... E05C 17/28 16/49
4,419,786 A * 12/1983 Surko, Jr. ..... E05F 3/22 16/51
4,506,407 A * 3/1985 Downey ..... E05C 17/28 16/320
4,785,493 A * 11/1988 Tillmann ..... E05F 3/104 16/53
4,837,890 A * 6/1989 Tully ..... E05C 17/28 16/71
4,847,946 A * 7/1989 Nam ..... E05F 3/102 16/53
4,858,272 A * 8/1989 Ogawa ..... E05F 3/221 16/71
5,666,692 A * 9/1997 Toledo ..... E05F 3/104 16/51
5,829,097 A * 11/1998 Toledo ..... E05C 17/26 16/53
5,829,508 A * 11/1998 DeBower ..... E05F 3/221 16/49
5,842,255 A * 12/1998 Luca ..... E05C 17/30 16/49
5,956,806 A * 9/1999 Tutikawa ..... E05F 3/02 16/49
6,138,412 A * 10/2000 Rieckmann ..... E05F 15/53 49/340
6,684,453 B2 * 2/2004 Wang ..... E05F 5/006 16/294
8,402,606 B1 * 3/2013 Tsai ..... E05F 3/18 16/49
8,875,344 B2 11/2014 Salutzki et al.
2002/0066157 A1 * 6/2002 Chen ..... E05F 3/104 16/58
2002/0133904 A1 * 9/2002 Donovan ..... E05F 3/16 16/49
2004/0035057 A1 * 2/2004 Backman ..... E05F 3/102 49/340
2005/0125947 A1 * 6/2005 Kral ..... E05F 1/1066 16/67
2009/0320236 A1 * 12/2009 Yamamuro ..... E05F 3/102 16/64
2013/0081227 A1 * 4/2013 Hensh ..... E05F 3/104 16/53
2013/0086771 A1 * 4/2013 Blockley ..... E05F 3/12 16/56
2015/0322705 A1 * 11/2015 Lee ..... E05F 3/102 16/53

* cited by examiner

COMBINATION HYDRAULIC AND PNEUMATIC DOOR CLOSER

CROSS-REFERENCE TO RELATED APPLICATIONS

This application is a continuation-in-part of U.S. application Ser. No. 14/795,004 filed Jul. 9, 2015, which in turn claims priority to Chinese Application No. CN 201510318849.8 having a filing date of Jun. 11, 2015 the entire contents of both applications being incorporated by reference.

FIELD OF TECHNOLOGY

The following relates to the field of door closers, in particular a door closer capable of adjusting its closing speed.

BACKGROUND OF THE INVENTION

The closing speed of a door closer is usually controlled by controlling the flow velocity of oil therein. However, the viscosity of oil varies upon changing temperature, to affect the closing speed of door closers greatly in the regions having big diurnal temperature amplitude, e.g. North America and the North China. It can be known from the experiments, the closing time of a hydraulic door closer is about 8 seconds at 25° C., the closing time is increased to about 2 minutes, which is 15 times the former. A much longer closing time can cause many problems, for example, the cold air in winter can enter the house easily, or a security flaw will appear. Moreover, it is difficult for users to adjust the door closer, the above flaws should increase the maintenance service cost and may incur a risk of oil spilling.

Accordingly, a primary objective of the present invention is the provision of an improved door closer.

Another objective of the present invention is the provision of a door closer having both a pneumatic cylinder and a hydraulic cylinder.

Another objective of the present invention is the provision of a door closer having dual hydraulic and pneumatic functions.

A further objective of the present invention is the provision of an improved door closer, which overcomes the problems of the prior art.

Yet another objective of the present invention is the provision of a door closer which is economical to manufacture, and durable and safe in use.

These and other objectives have become apparent from the following description of the invention.

SUMMARY OF THE INVENTION

A door closer according to the present invention has an adjustable closing speed, which is less influenced by temperature, and has a constant closing speed.

The door closer according to embodiments of the invention, comprises a pneumatic cylinder on the door frame, a hydraulic cylinder on the door, and a lever; one end of the lever is movably connected to the pneumatic cylinder, and the other end is connected to the hydraulic cylinder.

The pneumatic cylinder comprises a housing arranged on the door frame, and a sliding member within the housing. A hermetic chamber is formed at one end of the housing. An adjustable valve, for adjusting the exhaust of the hermetic chamber, is provided on the hermetic chamber. The lever is pivotally attached to the sliding member.

The hydraulic cylinder comprises a housing on the door, a spring in the housing, a piston and a cam follower or roller connected to the spring, and a rotatable cam for transferring the spring energy to the roller. The lever is fixedly connected to the cam.

Furthermore, the sliding member comprises a sliding block, a piston and a joint rod for connecting the sliding block and the piston.

Furthermore, the sliding member includes a piston having a periphery groove, a seal ring movably configured in the groove, and an air intake or passageway through the sliding member.

More particularly, the piston has a first side wall and a second side wall are formed at the groove, wherein the first side wall is adjacent to the hermetic chamber while the second side wall is opposite the first side wall. A first air intake is configured on the first side wall.

A gap is provided between the second side wall and an inner side wall of the sliding rail. The second side wall is inclined from the bottom of the groove, such that air enters the hermetic chamber through the first air intake and the gap when the piston slides towards door hinge, such that the air in the hermetic chamber is then compressed and the seal ring seals the gap, and thereby the air can be exhausted only by a regulating valve at the opposite end of the cylinder. Therefore, the counteraction to the piston can be adjusted by adjusting the exhaust of the regulating valve, and thereby the sliding speed of the sliding block can be adjusted.

In the preferred embodiment, the elastic component is a spring, and the pulley is a cam. The driving components comprises a driving piston configured at one end of the spring, and a cam roller on the driving piston. The cam roller is tangent to the profile of the cam. The intersection of the cam roller and the cam deviates from a line through the center of the cam roller to the shaft of the cam. The other end of the spring is connected with the side wall of the receiving chamber. The profile of the cam is designed to balance the varied resilience of the spring, such that the door is closed uniformly. Further, in order to close the door eventually, the spring ensures that there is a sufficient thrust to close the door fully.

In an alternative embodiment, the pulley is a gear, and the driving component is a rack engaged with the gear. The rack is connected to one end of the spring, and the other end of the spring is connected with a side wall of the receiving chamber.

Preferably the hydraulic cylinder is configured on the door, and with the driving apparatus positioned within the cylinder chamber.

Furthermore, the adjusting member is a regulating valve, for convenience.

Furthermore, the sliding rail is a pneumatic cylinder. The regulating valve is configured on one end of the hermetic chamber, of this cylinder, and a vent is configured on the other end of the hermetic chamber. A slot for the lever is arranged on the cylinder.

For aesthetics purpose, the pneumatic gas adjusting apparatus is embedded into the beam of the door frame, and the hydraulic cylinder housing is embedded into the top of the door.

Compared with the prior art, the beneficial effects are (1) The hermetic chamber is formed by the piston and the cylinder, such that the sliding speed of the sliding block, and further the closing speed of the door, can be controlled by adjusting the regulating valve. As the air flow is insensitive to air temperature, the closing speed of the door can be constant whatever the air temperature varies. Thus, the regulating valve can be adjusted when the door closer is installed, for constant reliability and operation.

(2) The driving structure is formed by the cam and the spring. When the door starts closing, the spring possesses a great resilience, but when the door is almost closed completely, the spring possesses a small resilience. The closing force can be adjusted by the profile of the cam as the resilience of the spring is varied all the way, thus the door is closed at a uniform speed. In addition, the cam can ensure there is a sufficient thrust to the door being locked eventually, and eliminates the risk of hitting people passing through the door.

(3) The use of air for controlling door closing reduces the cost and the maintenance service fee, and eliminates the contamination of hydraulic fluid.

FIG. 6 is an enlarged view of the regulating value in a partially closed position.

BRIEF DESCRIPTION OF THE DRAWINGS

Preferred embodiments of the present invention will be further described in detail hereinafter with reference to the accompanying drawings.

REFERENCE LIST

Figure 1:
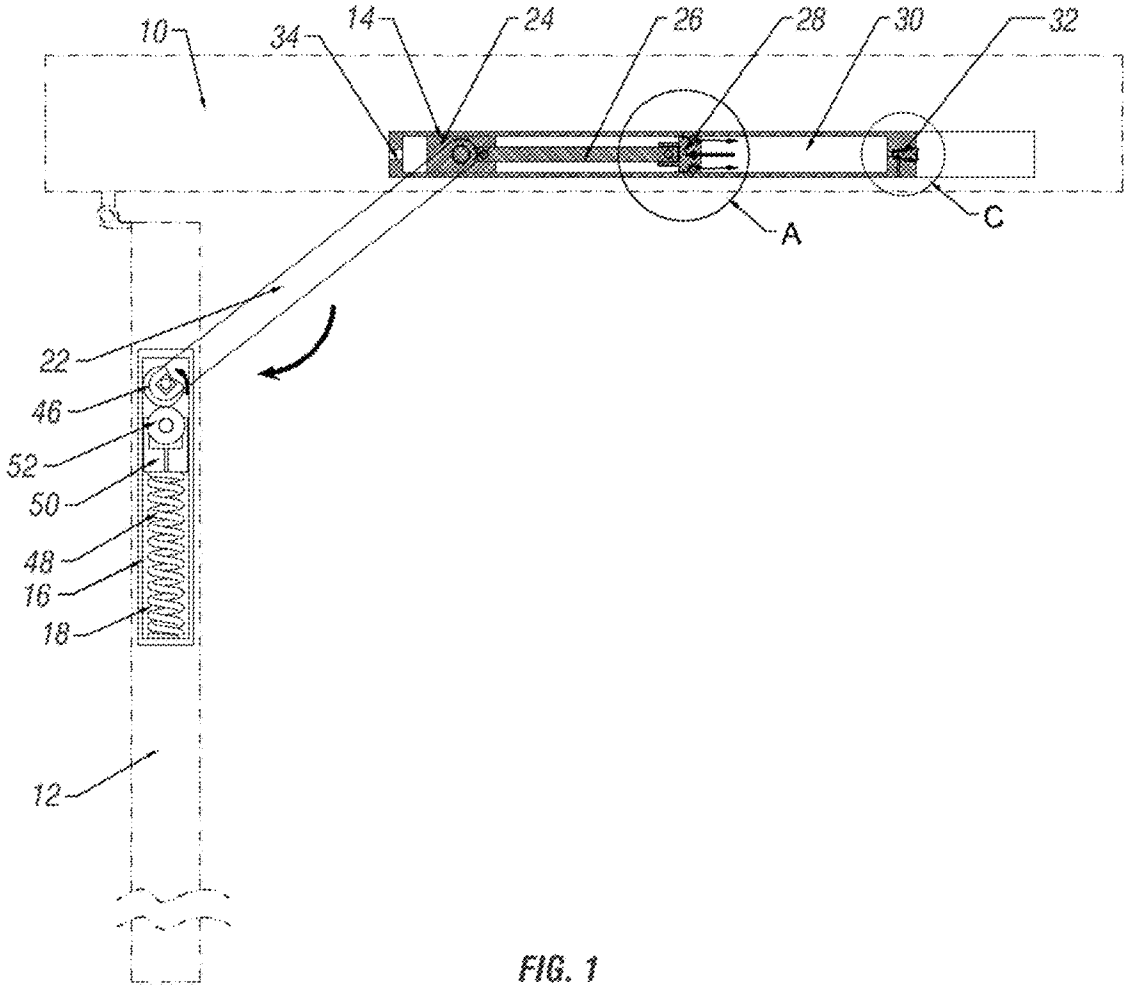
FIG. 1 is a structural view of the door closer of the present invention, which is capable of adjusting its closing speed when the door is open at the angle of 90 degrees.
Figure 2:
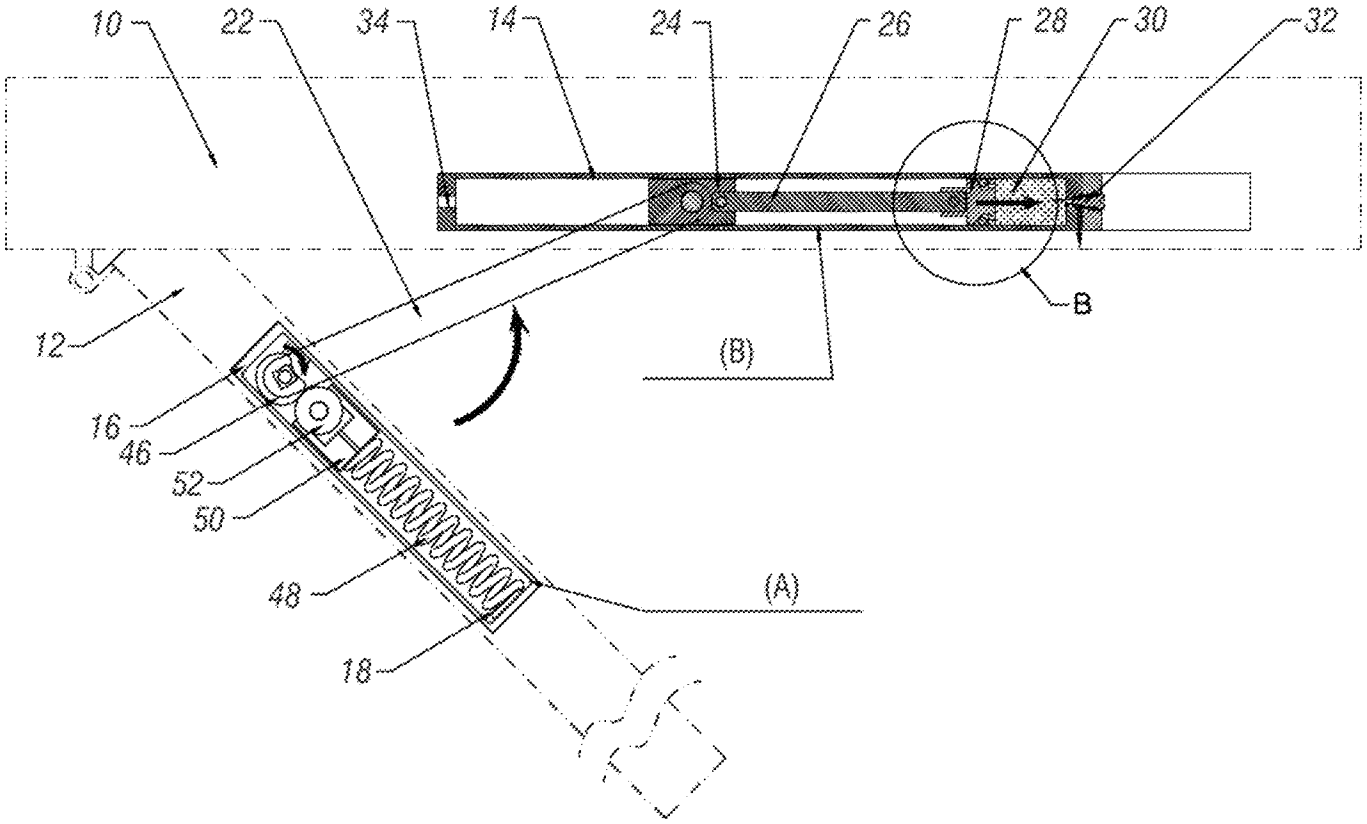
FIG. 2 is a structural view of the door closer capable of adjusting the closing speed when the door is open at the angle of 45°.

10—door frame
12—door
14—pneumatic cylinder
16—hydraulic cylinder
18—receiving chamber
20A—rack and pinion cylinder
22—lever
24—sliding block
26—joint rod
28—piston
30—hermetic chamber
32—regulating valve
34—vent
36—groove
38—seal ring
40—first side wall
42—second side wall
44—first air intake
45—gap
46—cam
48—spring
50—driving piston
52—cam roller
53—gear
54—rack
56—contact point
58—center line
60—piston movement for door opening
62—ball valve
63—hole in piston
64—return passage
66—piston movement for door closing
68—oil flow path for door closing
69—return passage
70—regulating valve

DETAILED DESCRIPTION OF THE PREFERRED EMBODIMENTS

Preferred embodiments of the invention will be further described in detail hereinafter with reference to the accompanying drawing. However, it should be understood that the preferred embodiments herein are only described for explaining the present invention, and the invention is not limited to the embodiments described herein.

Embodiment 1

As shown in the figures a door closer mounted on or in a door frame 10 and a door 12. The closer 10 is capable of adjusting its closing speed, and comprises a pneumatic cylinder 14 mounted in the door frame 10, and a hydraulic cylinder 16 mounted in the door 12. A receiving chamber 18 is formed inside the cylinder 16. A driving apparatus (described below) is mounted in the receiving chamber 18. A lever 22 connects the gas adjusting apparatus 24, 26, 28 and the driving apparatus.

A gas adjusting apparatus 24, 26, 28 is provided inside the pneumatic cylinder 14, and comprises a sliding block 24, a piston 28 and a joining rod 26 for connecting the sliding block 24 and the piston 28. A hermetic chamber 30 is formed by the piston 28 at one end of the cylinder 14. A regulating valve 32, for adjusting the exhaust velocity of the hermetic chamber 30, is threadably mounted in the wall of the hermetic chamber 30 at one end of the pneumatic cylinder 14. The other end of the cylinder 14 opposite the hermetic chamber 30 is provided with a vent 34.

The piston 28 has an air passageway comprising a groove 36 on the periphery of the piston 28, and a seal ring 38 movably configured in the groove 36. The groove 36 has a first side wall 40 and a second side wall 42 is opposite the wall 40. A first air intake 44 extends from the first side wall 40 to the chamber 30. There is a gap 45 between the second side wall 42 and the inner side wall of the cylinder 14. The first side wall 40 is in a plane perpendicular to the direction of movement of the piston 28, while the second side wall 42 is an inclined plane from bottom of the groove 36.

The driving apparatus comprises a cam 46, a spring 48 and driving components 20, inside the chamber 18 of the hydraulic cylinder 16. The driving components 20 comprise a driving piston 50 and a cam roller 52 configured on the driving piston 50. One end of a spring 48 is connected to an end of the chamber 18 while the other spring end is connected to the driving piston 50. The intersection of the cam roller 52 and the cam 46 deviates from a line from the center of the cam roller 52 to the shaft of the cam 46.

One end of the lever 22 is hinged to the sliding block 24, while the other end of the lever 22 is fixed to the shaft of the cam 46.

The pneumatic cylinder 14 is embedded into the beam of the door frame 10, and the hydraulic cylinder 16 is embedded into the top of the door 12. However, the cylinders 14 and 16 of embodiments of the present invention is not limited to such positions, and may be configured at the bottom of the door frame and the door instead, upon actual requirement. The cylinders 14 and 16 may also be mounted to the exterior of the door frame 10 and the door 12. The cylinders 14 and 16 may also be reversed such that cylinder 14 is on or in the door 12 and the cylinder 16 is on or in the door frame 10.

The cylinder 14 is used as a guide rail for the sliding block 24, however, this is not a limitation to embodiments of the present invention. Alternatively, the cylinder 14 can be formed in two parts, wherein one part would be a hermetic cylinder for installing the piston 28, while the other part would be an open guide rail to cooperate with the sliding block 24.

The sliding members in the assembly are the sliding block 24 and the piston 28, which are connected together by the joint rod 26, however, this is not a limitation to embodiments of the present invention. Alternatively, the sliding block 24 and the piston 28 could be integrated together inside the cylinder 14.

The operation of the door closer of the present invention is as follows:

When the door 12 is opened manually, the door 12 drives the sliding block 24 sliding towards left side in FIG. 1 through the lever 22, then the sliding block 24 brings the piston 28 sliding towards left side through the joint rod 26, so that air enters the hermetic chamber 30 through the gap 45 and the first air intake 44. Meanwhile the lever 22 drives the cam 46 to rotate about its axle. The cam 46 drives the cam roller 52 to compress the spring 48. When the door 12 is released, the spring 48 decompresses and drives the cam roller 52, which in turn drives the cam 46 rotating about its axle.

Simultaneously, the sliding block 24 is driven by the lever 22 and slides towards right side in FIG. 1, while the piston 28 is driven by the joint rod 26 and slides towards right side to compress the air in the hermetic chamber 30, whereby the air in the hermetic chamber 30 counteracts the movement of the piston 28, and the seal ring 38 is forced to contact with the second side wall 42 and seals the gap 45, such that the air in the hermetic chamber 30 can only be exhausted through the regulating valve 32. The counteraction force to the piston 28 can be adjusted by adjusting the exhaust of the regulating valve 32, and accordingly, the sliding speed of the sliding block 24 and the closing speed of the door is adjusted. When the door 12 starts closing, the spring 48 possesses a great resilience and can provide a great pushing force, but when the door almost closes completely, the spring 48 possesses a small resilience and only provides a little pushing force to the cam 46. Therefore, the profile of the cam 46 may be designed to balance the resilience variation of the spring. When the door 12 starts closing, the intersection of the cam roller and the cam is designed to be adjacent to the straight line from the shaft of the cam 46 to the center of the cam roller 52 as close as possible, and when the door 12 almost closes completely, the intersection is away from the straight line, whereby the closing speed of the door is almost uniform. In addition, the cam and cam roller ensure there is a sufficient thrust to the door 12 being locked eventually.

Figure 3A:
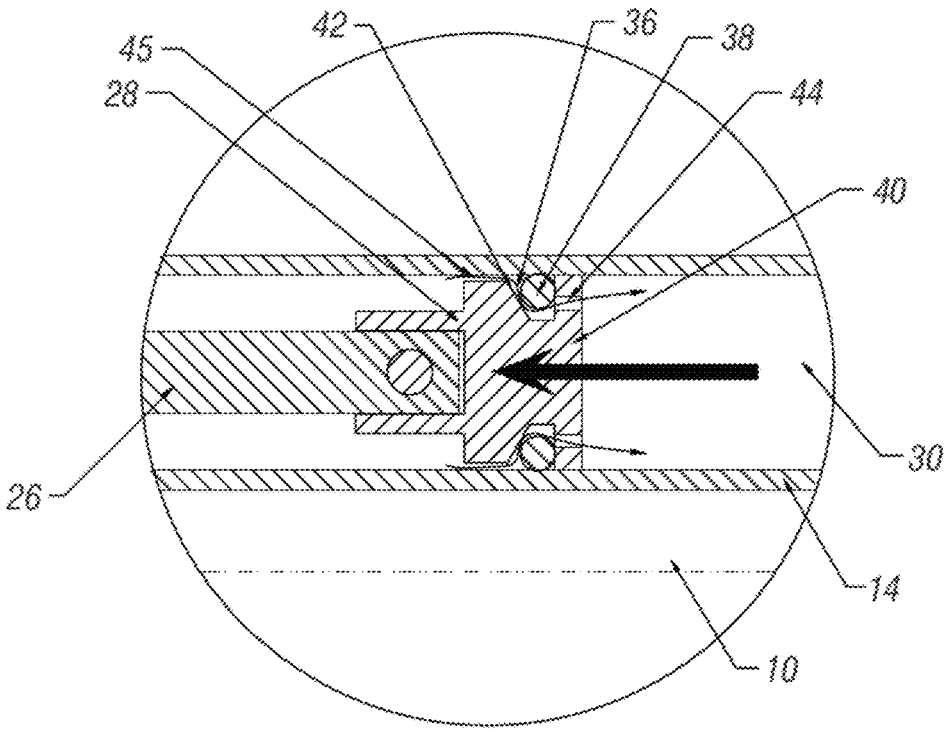
FIG. 3A is an enlarged partial view of the pneumatic cylinder of the door closer during opening of the door, taken along line A of FIG. 1.
Figure 3B:
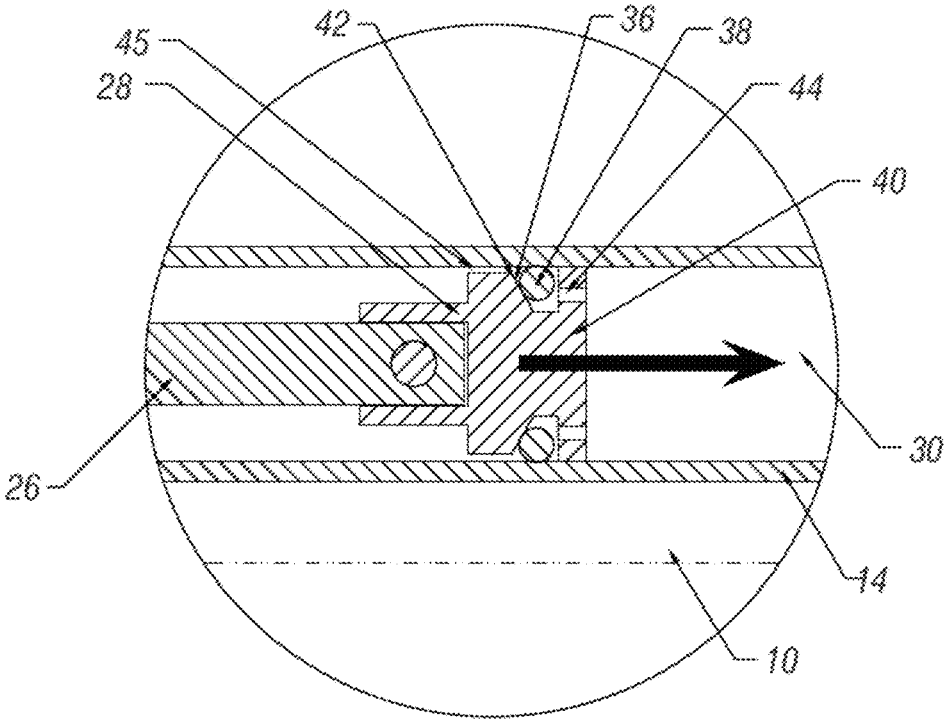
FIG. 3B is a partial enlarged view of section B of FIG. 2, during closing of the door.
Figure 4A:
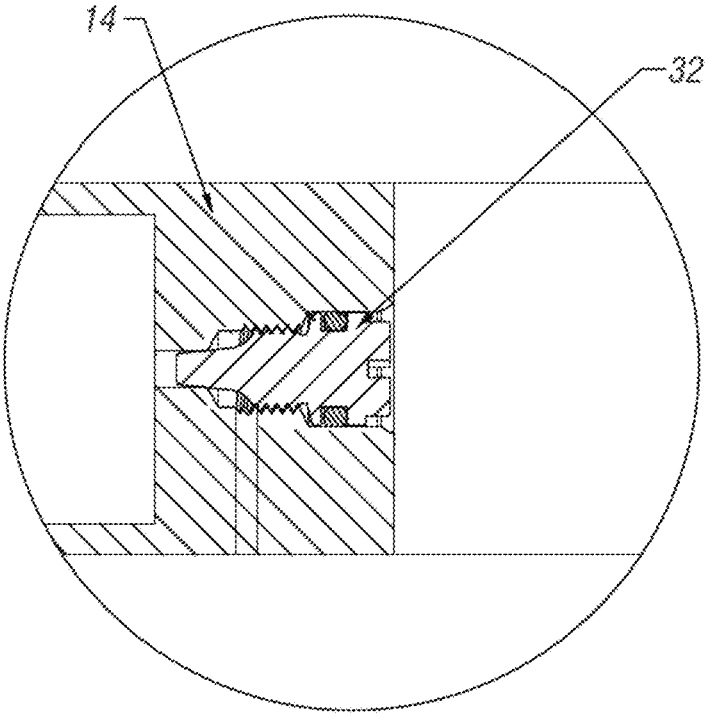
FIG. 4A is an enlarged view of the regulating valve in a substantially closed position, taken along line C of FIG. 1.
Figure 4B:
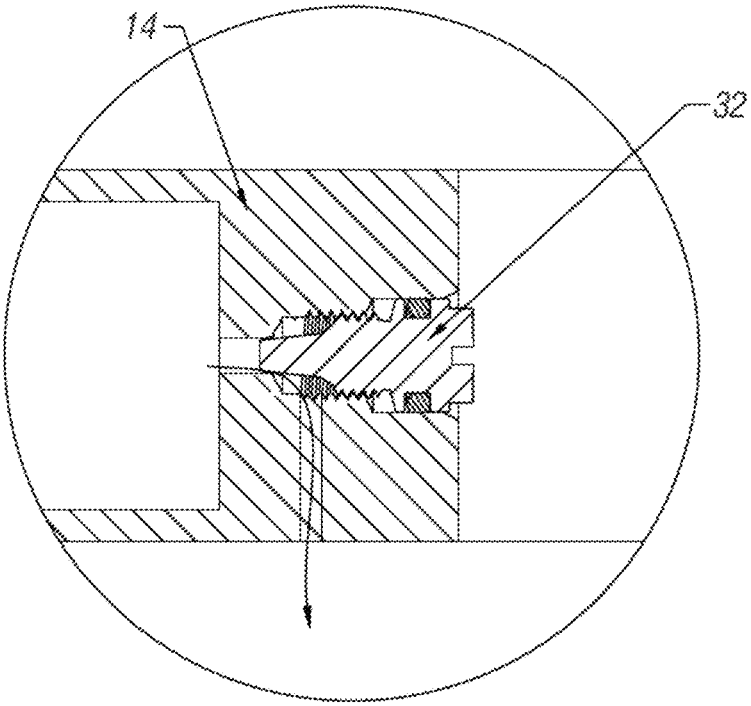
FIG. 4B is a view similar to FIG. 4A with the regulating valve in substantially open position.
Figure 5:
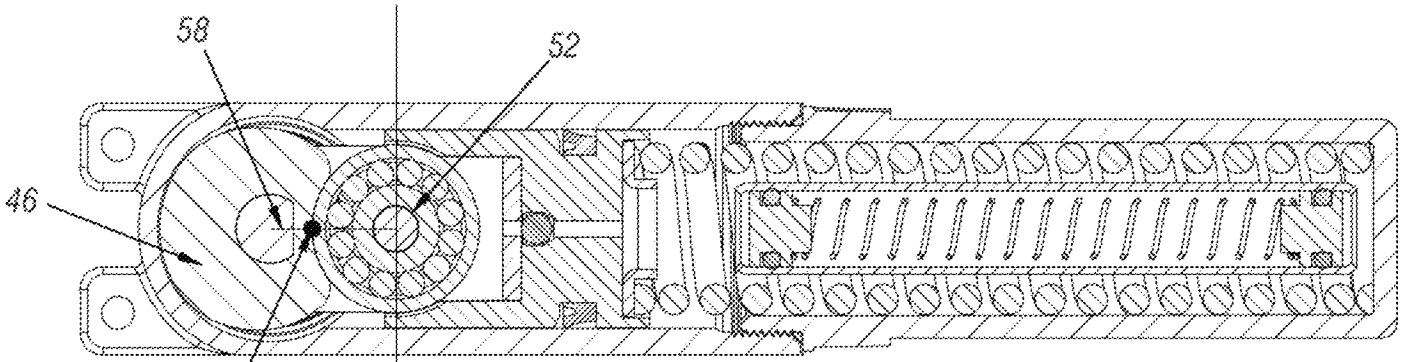
FIG. 5 is a sectional view of the hydraulic cylinder when the door is in an enclosed position.
Figure 6:
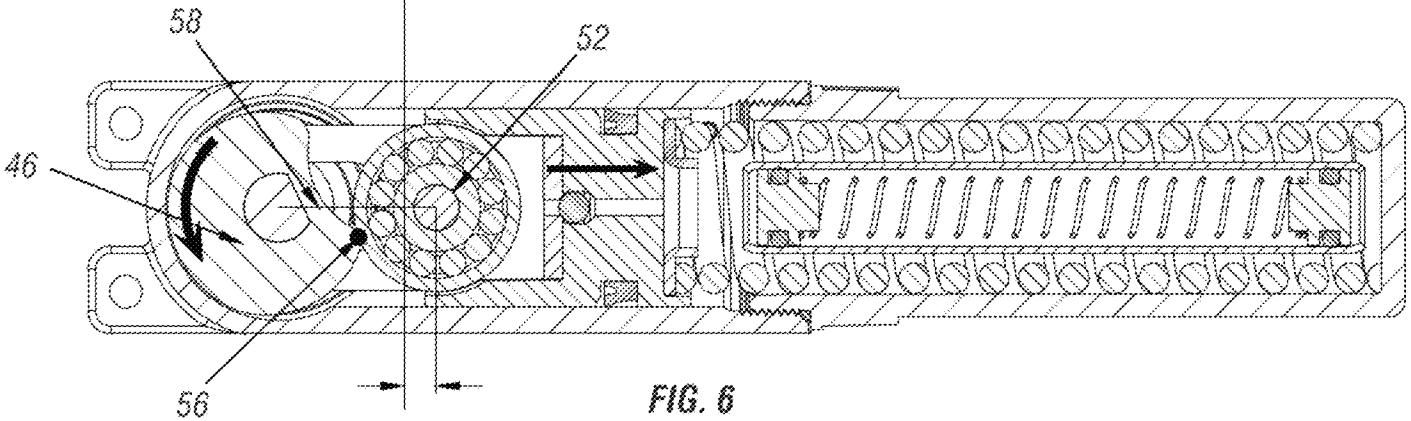
FIG. 6 is a sectional view of the hydraulic cylinder when the door is in an open position.

The airflow for the pneumatic cylinder 14 is shown in FIGS. 3A, 3B, 4A, and 4B. When the door 12 is opening, the piston 4 slides to the left, as seen in FIG. 3A and as designated by the heavy arrow. This movement of the piston 28 forces air through the gap 45 and into the chamber 30, as seen by the light arrows in FIG. 3A. As the door 12 closes, the piston 28 slides to the right within the cylinder 14, as represented by the dark arrow in FIG. 3B. The seal 38 prevents air from flowing backwards through the gap 45. As the door closes, the piston compresses the air into chamber 30, which is exhausted or expelled out of the chamber 30, as indicated by the arrow in FIG. 4B. Threading the valve 32 into or out of the end of the cylinder 14 regulates the volume of the air that can be exhausted from the cylinder 14 as the door closes.

Figure 7:
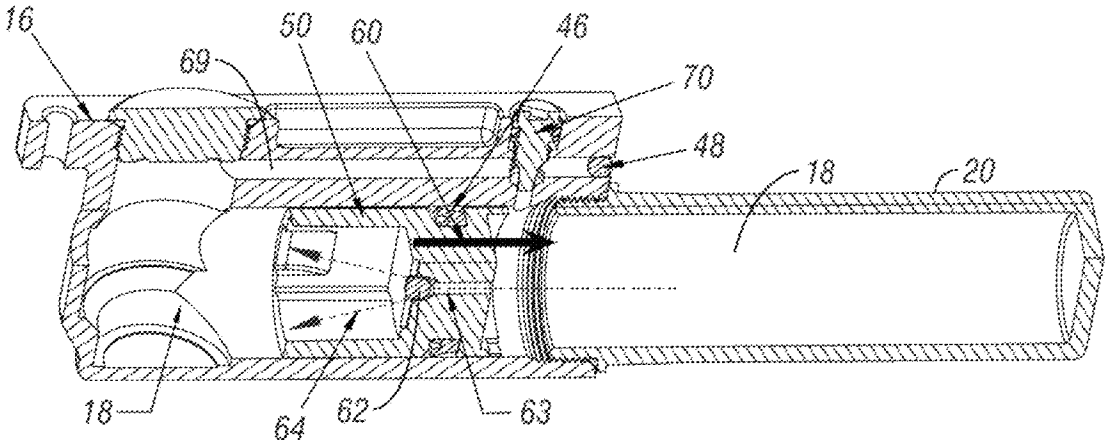
FIG. 7 is a sectional view of the hydraulic cylinder showing the fluid flow path when the door is opening, with some components on parts removed for clarity.
Figure 8:
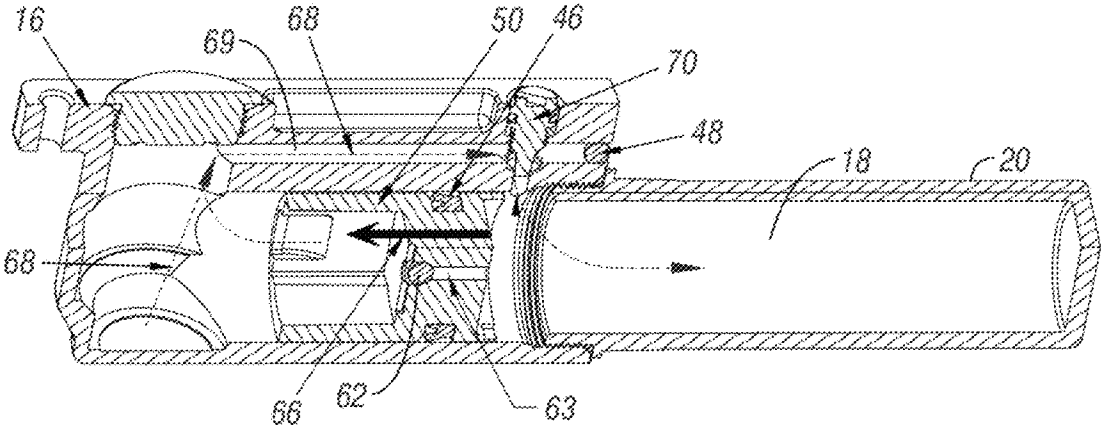
FIG. 8 is a sectional view of the hydraulic cylinder, similar to FIG. 7, showing the fluid flow path when the door is closing.
Figure 9:
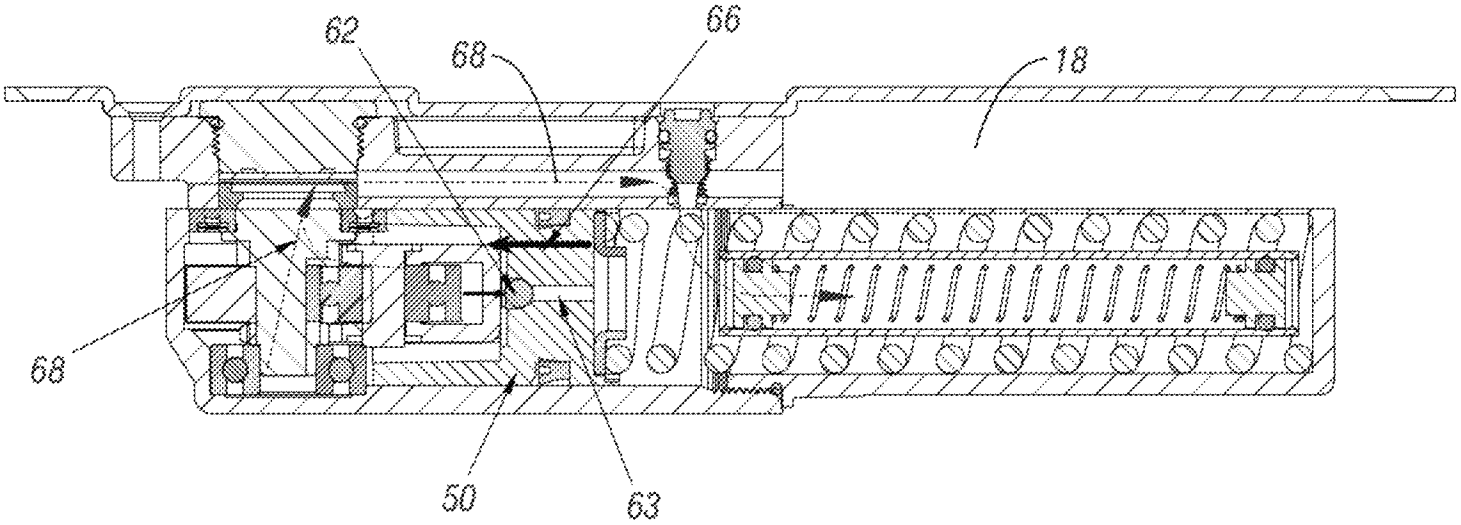
FIG. 9 is another sectional view of the hydraulic cylinder showing the fluid flow path when the door is closing.
Figure 10:
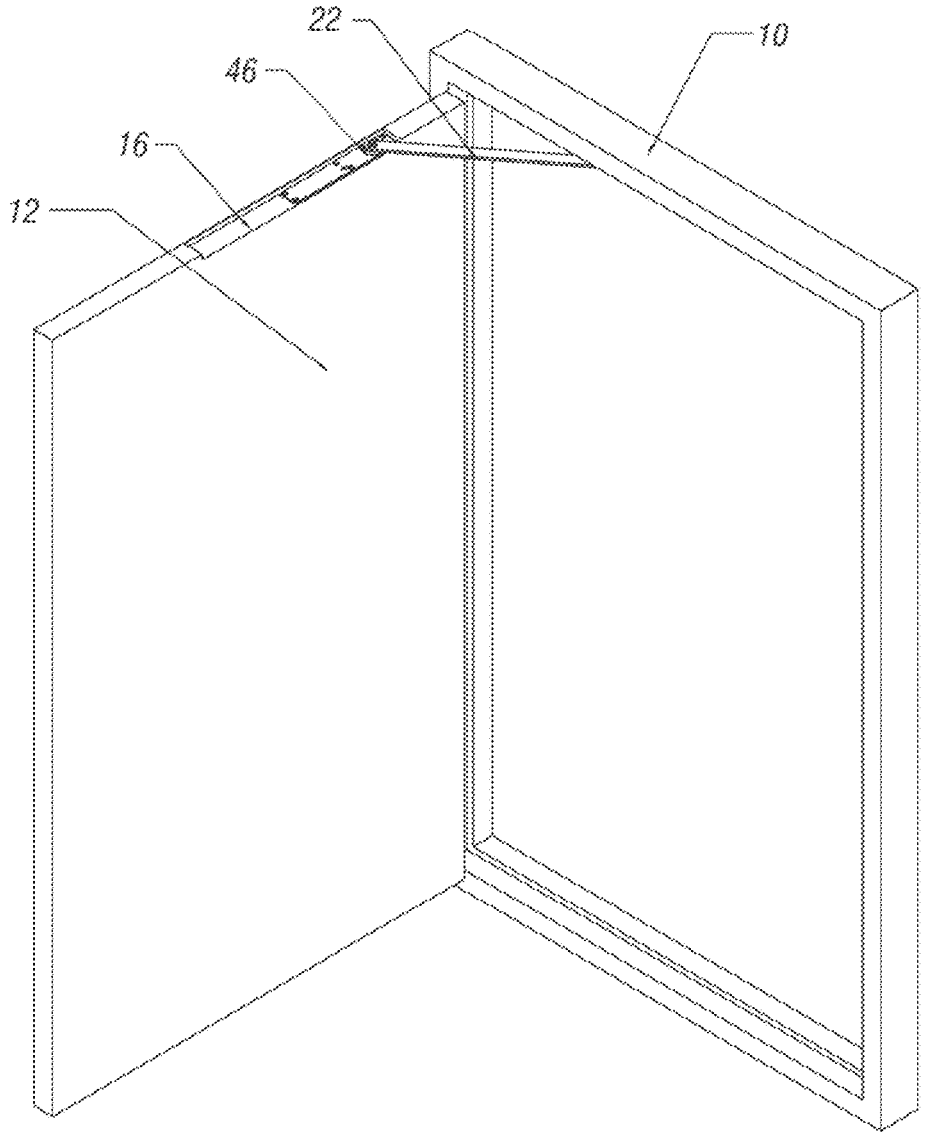
FIG. 10 is sketch showing the dual door closer of the present invention on a door and a door frame.
Figure 11:
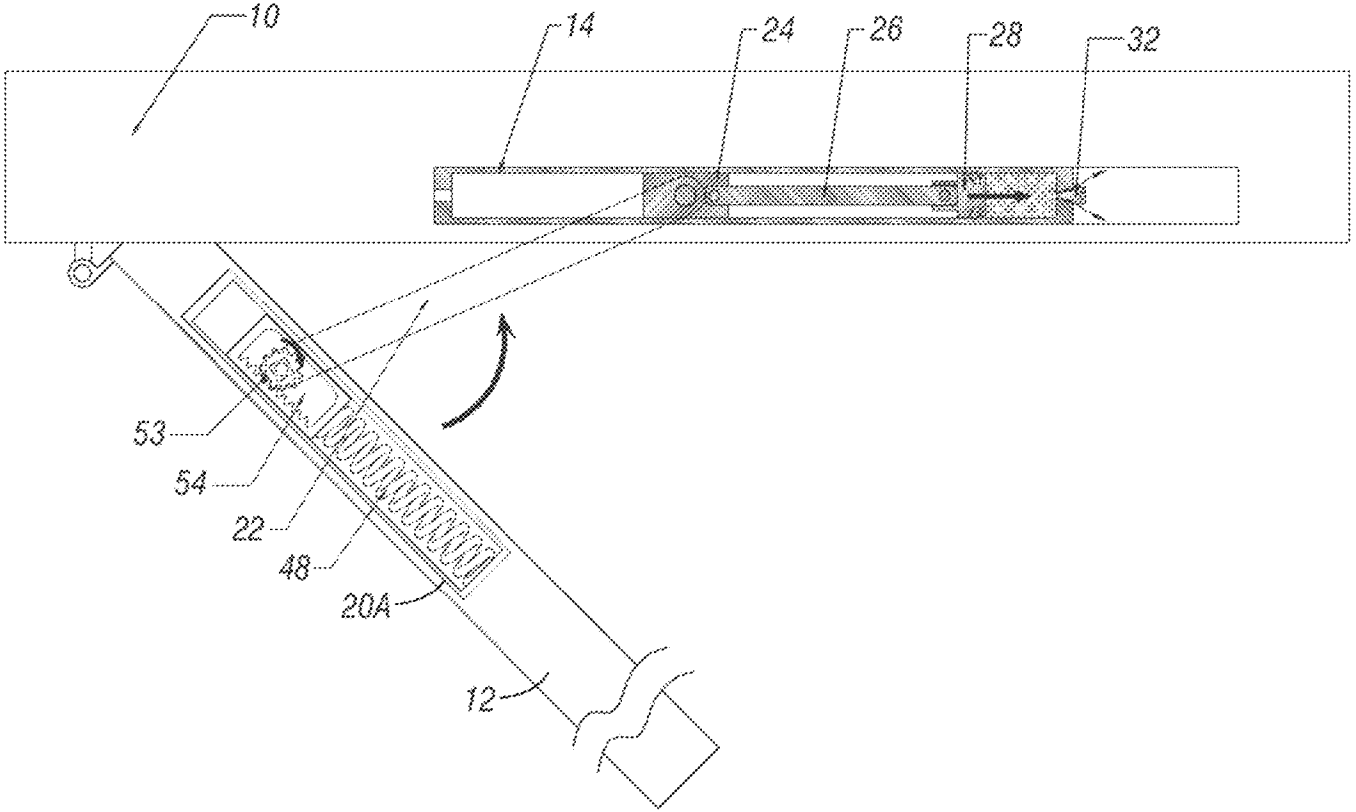
FIG. 11 is a view of a second embodiment of the door closer capable of adjusting its closing speed.

The flow of fluid in the hydraulic cylinder 16 as the door opens and closes is shown in FIG. 7-9. More particularly, as the door opens, the piston 50 slides to the right, as indicated by the dark arrow in the passageway black, and past the ball valve. Shown in FIG. 8, when the door closes, the piston 50 moves to the left, as indicated by the heavy arrow, and follows the path of the broken arrow back to the chamber 18 of the cylinder 20. A second regulated valve in the cylinder 16 controls the rate in which the fluid flows back into the chamber 18.

Embodiment 2

As shown in FIG. 1, the structure and work principle in this embodiment are identical to those in Embodiment 1, except for the driving components. In this alternative embodiment, the pulley is a gear 53 and the driving component is a rack 54 engaged with the gear 53. One end of the rack 54 is connected to the spring 48. One end of the lever 22 is hinged to the sliding block 24 while the other end is fixed to the shaft of the gear 53.

When the door is open, the lever 22 rotates the gear 53, which drives the rack 54 towards the spring 48, thereby the spring 48 possesses a great resilience. When the door 12 is released, the spring 48 drives the rack 54, which rotates the gear 53, such that the lever 22 drives the sliding block 24 towards right side in FIG. 7, whereby the door 12 can close automatically. The counteraction to the piston 28 can be adjusted by adjusting the exhaust of the regulating valve 32 and thereby the closing speed of the door 12 is adjusted.

In embodiments of the present invention, the hermetic chamber is formed by the piston and the pneumatic cylinder 14, such that the sliding speed of the sliding block, and further the closing speed of the door, can be controlled by adjusting the regulating valve 32. As the air flow is insensitive to air temperature, the closing speed of the door 12 can be constant whatever the air temperature varies. Thus the regulating valve 32 long can be adjusted when the door closer is installed, for consistent and reliable use all year.

Such a door closer reduces the cost and eliminates the contamination hydraulic of oil spilling.

The other structure of the door closer in the embodiments may refer to known door closers.

What is claimed is:

1. A closer for a screen door pivotally mounted in a door frame for movement between open and closed positions, the closer comprising:

a hydraulic cylinder;

a pneumatic cylinder;

one of the cylinders being mounted to the door frame and the other of the cylinders being mounted to the screen door;

a rigid arm extending between the cylinders;

the pneumatic cylinder having a first piston, and the arm having a first end pivotally connected to the first piston;

the hydraulic cylinder having a second piston acting on a cam for controlling movement of the second piston, and the arm having a second end connected to the cam.

2. The closer of claim 1 wherein the hydraulic cylinder is mounted in the door frame and pneumatic cylinder is mounted in the screen door.

3. The closer of claim 1 further comprising an adjustable valve on the pneumatic cylinder to control exhaust from the pneumatic cylinder during closing of the screen door.

4. The closer of claim 1 wherein the hydraulic cylinder includes a spring to bias the second piston towards a door-closing position.

5. The closer of claim 4 wherein the spring is compressed when the door is opened and decompressed when the door is closed.

6. The closer of claim 1 wherein the cylinders are mounted in the door and in the door frame.

7. A method of closing a screen door mounted in a door frame, comprising:

mounting a hydraulic cylinder in one of the screen door and the door frame, the hydraulic cylinder having a first piston acting on a cam for controlling movement of the first piston;

mounting a pneumatic cylinder in the other of the screen door and the door frame, the pneumatic cylinder having a second piston;

connecting of the hydraulic and pneumatic cylinders with an arm, the arm having a first end connected to the second piston and a second end connected to the cam; and biasing the door towards the closed position, when the door is open, with the hydraulic cylinder; and controlling closing speed of the door with the pneumatic cylinder.

8. The method of claim 7 further comprising adjusting venting of the pneumatic cylinder with an adjustable valve.

9. The method of claim 7 further comprising drawing air into the pneumatic cylinder when the door opens and expelling air from the pneumatic cylinder when the door closes.

10. The method of claim 7 wherein the pneumatic cylinder prevents bouncing of the pneumatic cylinder while the door closes.

11. The method of claim 7 wherein the hydraulic cylinder is unbiased when the door is in the closed position.

12. The method of claim 7 wherein the biasing force is hydraulic pressure in the hydraulic cylinder.

13. The method of claim 7 wherein the biasing force is spring pressure in the hydraulic cylinder.

14. The method of claim 7 wherein the pistons retract when the door opens and extend when the door closes.

15. The method of claim 7 wherein the arm is rigid.

* * * * *